United States Patent [19]

Willus et al.

[11] 4,067,494

[45] Jan. 10, 1978

[54] NOZZLE TYPE CENTRIFUGAL MACHINE WITH IMPROVED SLURRY PUMPING CHAMBERS

[75] Inventors: Charles Arthur Willus, Bethel; Per Nyrop, Norwalk, both of Conn.

[73] Assignee: Dorr-Oliver Incorporated, Stamford, Conn.

[21] Appl. No.: 756,492

[22] Filed: Jan. 3, 1977

[51] Int. Cl.[2] ..... B04B 1/12; B04B 7/00

[52] U.S. Cl. ..... 233/3; 233/14 R; 233/34

[58] Field of Search ..... 233/3, 4, 14 R, 14 A, 233/16, 19 R, 19 A, 27, 29, 34, 38

[56] References Cited

U.S. PATENT DOCUMENTS

| | | | |
|---|---|---|---|
| 2,197,120 | 4/1940 | Bergmann | 233/3 X |
| 2,724,549 | 11/1955 | Brown | 233/3 X |
| 3,111,490 | 11/1963 | Halbach | 233/14 R |
| 3,350,296 | 10/1967 | Torobin | 233/14 R |
| 3,388,054 | 6/1968 | Keith | 233/14 R |
| 3,799,431 | 3/1974 | Lavanchy et al. | 233/3 |
| 3,876,135 | 4/1975 | Harvey et al. | 233/3 |
| 3,967,777 | 7/1976 | Canevari | 233/3 |
| 4,010,891 | 3/1977 | Kartinen | 233/3 |

*Primary Examiner*—George H. Krizmanich
*Attorney, Agent, or Firm*—Burtsell J. Kearns; Theodore M. Jablon

[57] ABSTRACT

A nozzle type centrifugal machine designed for two-fraction separation of feed slurry, wherein the rotor has a light fraction overflow at the top, while feed slurry as well as underflow return slurry from the nozzles are introduced into the rotor from below into respective feed accelerating pumping chambers, and wherein improvements in the pumping chambers results in reduced power requirement and in improved overall performance of the machine.

21 Claims, 17 Drawing Figures

FIG. 12
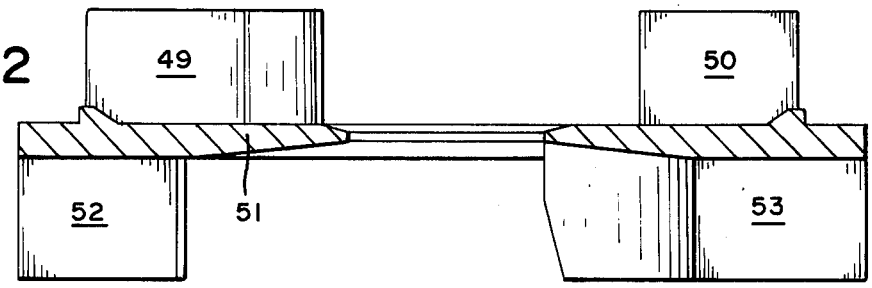
FIG. 11
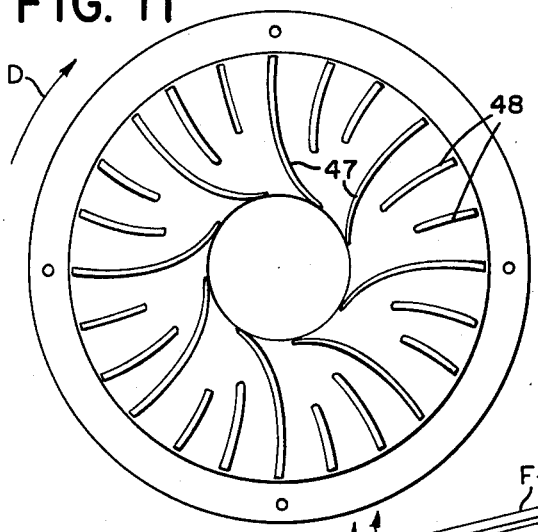
FIG. 10
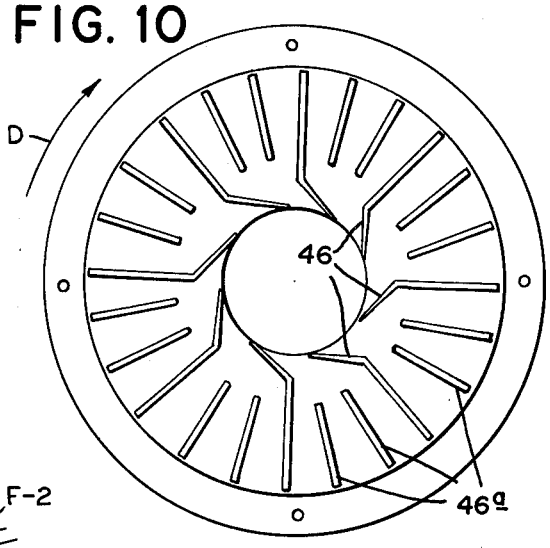
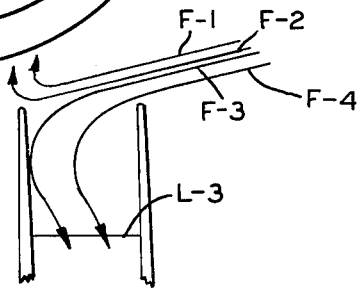
FIG. 15
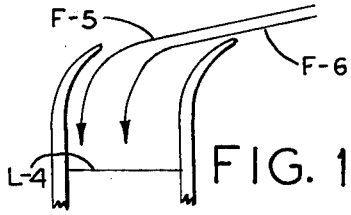
FIG. 16
FIG. 13
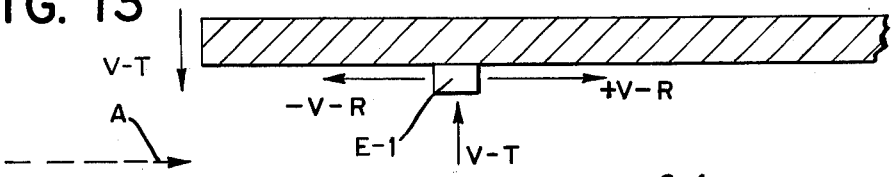
FIG. 14
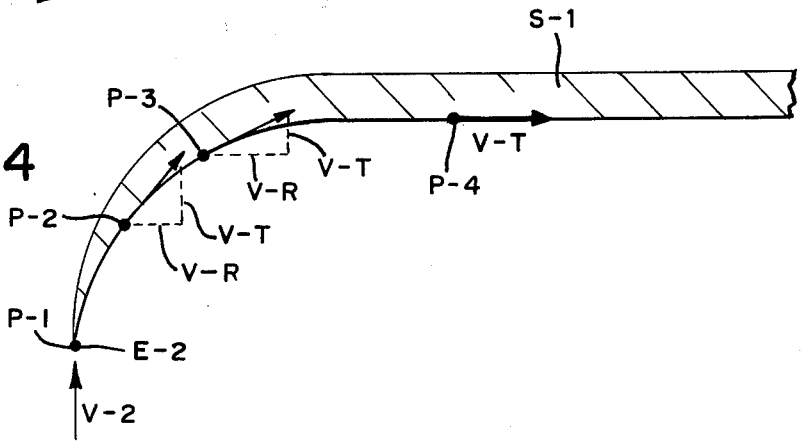

NOZZLE TYPE CENTRIFUGAL MACHINE WITH IMPROVED SLURRY PUMPING CHAMBERS

This invention relates to centrifugal machines of the nozzle type wherein a double-cone shaped rotor bowl has a separating chamber containing a stack of separating discs for effecting a two-fraction separation of a feed slurry into a heavy nozzle discharge slurry or socalled underflow fraction or concentrate delivered by the nozzles, and a light fraction or separated liquid delivered by overflow from the top end of the machine. Provision is made for a part of the underflow fraction to be returned to the separating chamber at a controllable rate, by introduction through the lower end of the rotor bowl.

In the type of rotor embodying the invention, both the nozzle discharge return material and the feed slurry are introduced by injection upwardly into the rotor, and into respective annular pumping chambers located one above the other. These pumping chambers herein termed the pumping section of the rotor, deliver the respective slurries upwardly into the separating chamber in the rotor bowl.

The two pumping chambers communicate respectively with a set of upright slurry feed tubes delivering into the stack of separating discs in an inner separating zone, and with a set of outwardly divergent underflow return tubes delivering a portion of the nozzle discharge slurry into an outer annular separating zone which surrounds the discs in the rotor bowl.

Feed slurry and underflow return material are injected upwardly into the respective pumping chambers. Depending upon preferences as dictated by different operating conditions and requirements, the upper pumping chamber may receive the underflow material, while the lower pumping chamber receives the feed slurry, or vice versa.

Internally, this rotor structure has a hub portion separating the pump section from the centrifugal separating chamber. A rotor shaft fixed to the hub portion extends upwardly through the top opening of the rotor bowl, which top opening provides the light fraction overflow.

The rotor shaft is surrounded concentrically by the customary spider member which being unitary with the hub portion extends upwardly towards the overflow. The radial ribs of the spider member have vertical outer edges over and around which vertical edges are fitted the aforementioned separating discs. The ribs providing between them vertical flow channels for delivery of the light fraction from the separating discs to the overflow.

An important technical aspect of this type of rotor appears from a comparison thereof with the nozzle type of rotors where feed slurry is supplied through the top opening of the rotor bowl into a feed well surrounding the shaft. The top end of this feed well is surrounded by the open upper end of the rotor bowl, which in turn determines the width or diameter of the circular top overflow edge. Underflow material is returned by upward injection into a single pump chamber at the bottom of the rotor bowl.

However, by supplying or injecting not only the return slurry, but also the feed slurry from below as in the machine embodying the invention, the feed well together with the top feed supply means are eliminated. This leaves the top overflow diameter unencumbered and free to be lessened, thereby allowing for a corresponding reduction of input energy required for making a desired centrifugal separation.

By the same token, the inside diameter of the separating discs is also reducible, thereby potentially increasing the effective volume of the centrifugal separating zone, as well as the available total area of the stack of separating discs.

It is among the objects of this invention to provide ways and means for minimizing the top overflow diameter, with the resulting gains due to a relative reduction in power requirements.

Another object is to generally improve the performance and separating efficiency of the machine by improving the pumping efficiency of the pumping chambers.

However, heretofore hidden problems present themselves, when attempting to attain these objectives, for instance due to the behavior of certain slurries to be handled by the machine, subject to operating conditions such as variation in feed rates applied to the respective pumping compartments.

Problems heretofore not recognized arise also, for example in large machines of the aforementioned type embodying the invention, where the rotor has a large number of underflow discharge nozzles, as many as can be accommodated along the periphery of the intermediate widest portion of the rotor bowl. For practical reasons, an equal number of underflow return tubes are provided, which may be in staggered arrangement with respect to the nozzles, so that the tubes may alternate with the nozzles. Again, for practical reasons the numbers of the vertical slurry feed tubes may be the same as that of the underflow retrun tubes, the arrangement being such that the feed tubes in turn alternate with the return tubes, thus registering radially with the nozzles. The feed tubes and the return tubes thus may become closely spaced to one another and crowded together along the peripheral portion of the aforementioned rotor hub, their spacing being controlled by the spacing of the nozzles.

Given that situation, according to discoveries underlying the invention, a problem presents itself with respect to structurally and functionally accommodating the pumping or impeller vanes in the respective pumping chambers without incurring adverse or retarding or back pressure effects upon the introduction of the slurries, or impairment of the slurry separation. For practical reasons each of the pumping chambers is to have the same number of impeller vanes, corresponding to the number of feed tubes, in order that each tube may be served individually by a pair of impeller vanes. The pumping pressure in each respective pumping chamber is thus to be distributed equally to each tube, all tubes are thus to receive equal shares of the slurries entering the machine, with the vanes thus providing a guiding as well as accelerating affect upon the slurry being pumped.

However, according to discoveries underlying this invention, the narrow or crowded spacing of the respective pumping vanes at their converging flow retarding inner ends, presents an obstacle to smooth entry of the slurry into the machine. In addition, there is found to be a flow impeding impact or collision of the slurries with the fast moving faces of the conventional straight radial pumping vanes heretofore standard in the pumping compartments of such a machine. This would result in the heretofore hidden or unrecognized problem of back spilling from the pumping chambers with intermixing of the respective slurries, and consequent adverse effects upon the separating and operating efficiency of the machine, as well as upon the power input needed for effecting the separation. For example, feed slurry from the upper pumping chamber might spill into the lower pumping chamber, diluting the underflow return slurry, and requiring re-concentration in the machine, even as return slurry from the lower pump compartment might spill into the housing of the centrifuge, constituting a drag on the rotor and thus presenting another obstacle to efficient operation. Conversely return slurry fed to the upper compartment might spill into the lower compartment to mix with the feed slurry to undergo re-separation in the machine, rather than be delivered at the nozzles directly by the underflow return tubes.

A proposal of simply shortening the pumping vanes would appear to remedy the foregoing drawbacks only to the extent that entry into the pumping spaces between the vanes would be facilitated. But that potential advantage must be weighed against potential disadvantages. One such disadvantage would be greater impact intensity of the feed slurry upon the inner end portion of the shortened blades again with potential back spilling as well as power loss, and with less effective guidance and acceleration available. A given overflow diameter would then become more critical, or would have to be increased, because of the shortening of the pumping vanes, thereby incurring the aforementioned power loss and loss of separating capacity of the machine.

According to the invention, the foregoing dilemma was overcome and high pumping efficiency attained by the provision of pumping vanes constructed and arranged for intercepting the respective feed slurries close to center, yet providing adequate inflow passage area for entry of the slurries between the vanes. In this way, the overflow diameter as well as the internal hydraulic flow resistance of the machine are minimized, with consequent reduction in required energy input and corresponding increase in separating capacity and operating efficiency of the machine.

In particular, such improvements are attainable by providing a combination of vertical long and short pump impeller vanes, wherein long vanes alternate with foreshortened or stunted vanes in the respective pump compartments. The long vanes, moreover, have an inner end portion that is bent or curved or deviated in the direction of rotation of the rotor when in operation. The shape of the bent or curvature is such as to eliminate the above mentioned impact effect and back spilling from the pump compartments, even while providing between them adequate entry passage area for the respective slurries entering the machine, and imparting for the centrally upflowing streams of feed suspension a smooth transition into an outward radial flow direction between the vanes. Once the slurry stream thus guided has thus smoothly entered into the space between the curved end portion of a respective pair of long or extended blades, the interposed foreshortened or stunted vanes between them take over the further subdivision of the diverted stream into equal shares being pumped into and through the respective feed tubes and return tubes, which tubes communicate through the peripheral portion of the rotor hub with the respective pumping chambers. Pumping pressure may thus be applied evenly to the respective tubes.

Specific features are concerned with the provision of composite pump impeller vanes, comprising means whereby the curved inner end portions thereof are removable or exchangeable. By exchange, the number of composite vanes could be varied relative to the interposed shortened or stunted vanes. In that case, increasing the number of the composite vanes would correspondingly reduce the number of the shortened vanes interposed between respective pairs of composite vanes, and vice versa. By exchange or substitution also, a number and arrangement of separate inner end curved vane portions can be established independently of the number and arrangement of the complement of the shorter vanes, yet having cooperative relationship therewith. Again, by way of exchange or substitution a set of vane portions of one curvature can be substituted for a set of vane portions of another curvature.

Other features and advantages will hereinafter appear.

Figure 7:
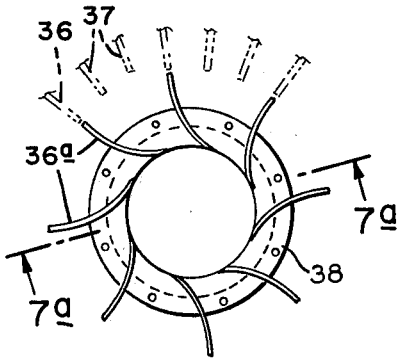
FIG. 7 is a detail plan view of the adaptor ring removed from FIG. 5.

FIG. *7a* is a vertical sectional view of the bladed adaptor ring member taken on line *7a—7a* of FIG. 7.

Figure 1:
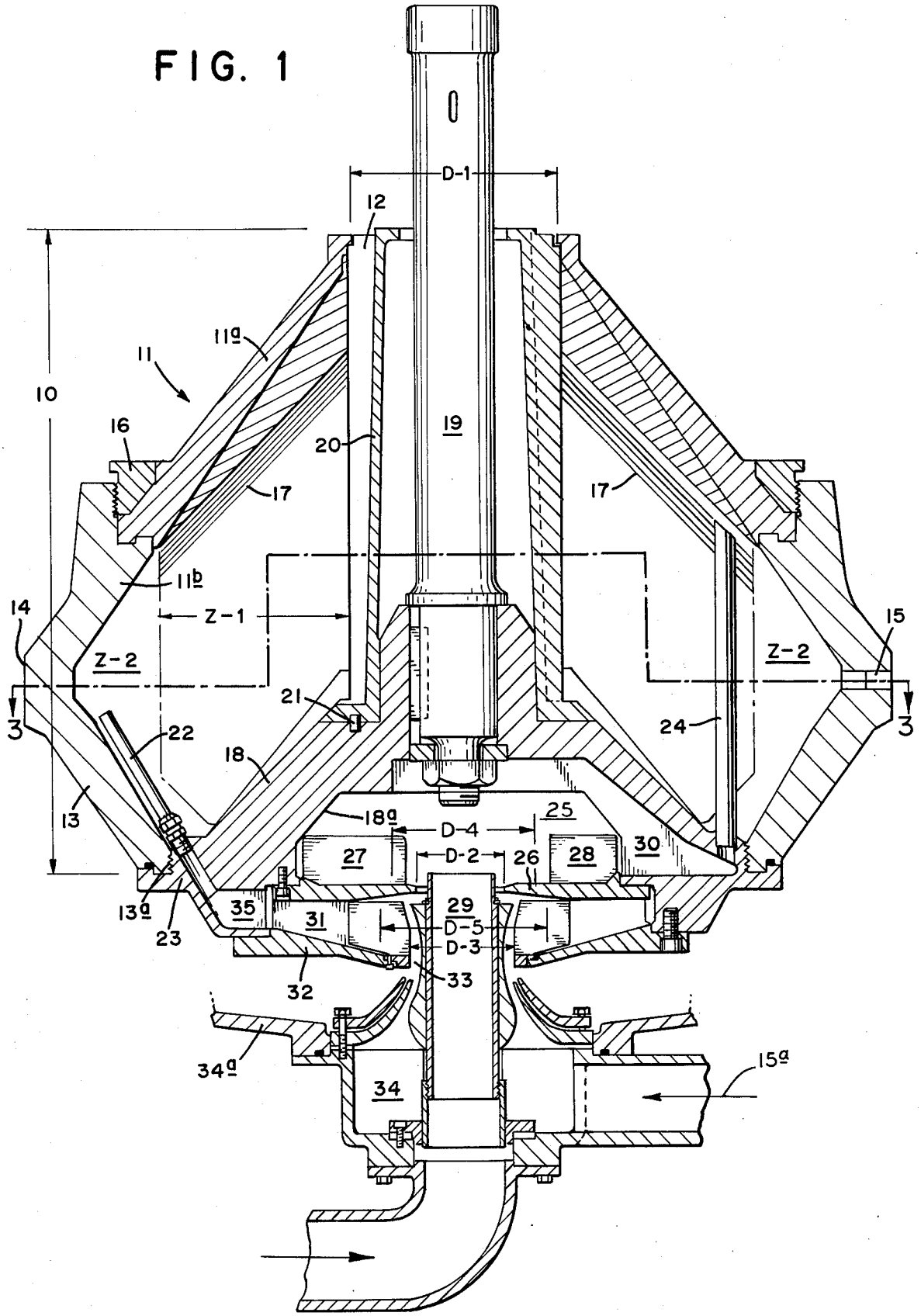
FIG. 1 is a vertical sectional view of the rotor, embodying one form of the invention, wherein the upper and the lower pumping chamber are related to the vertical feed pipes and the divergent return pipes respectively in the rotor bowl.
Figure 8:
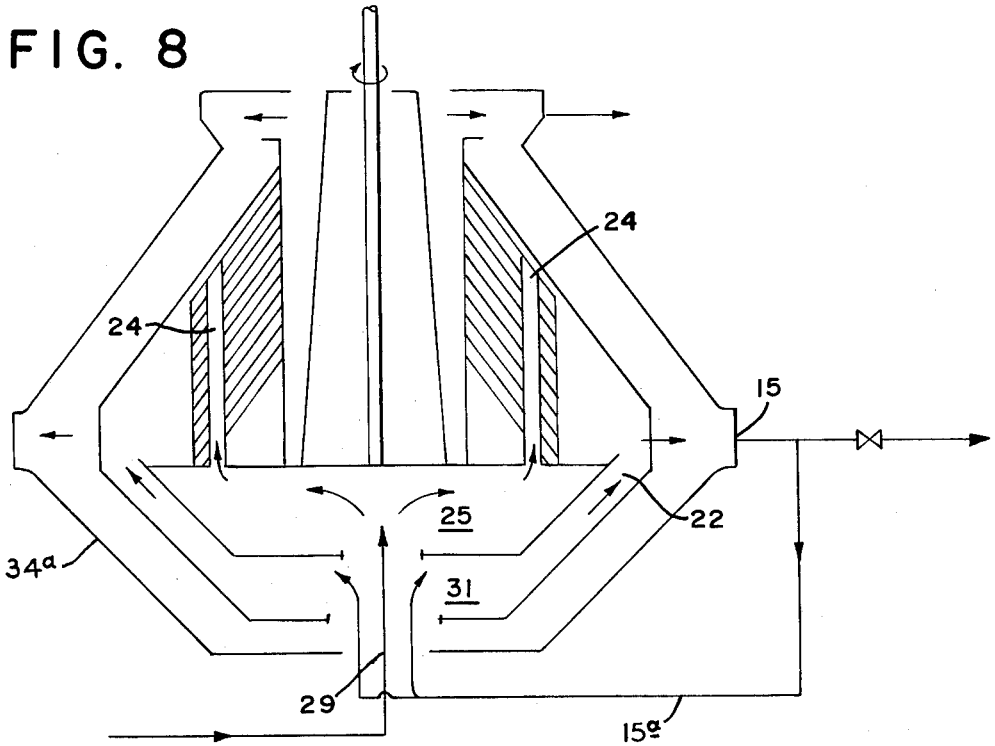

FIG. 8 is a schematic view of the rotor of the FIG. 1 embodiment, enclosed by a housing.

Figure 2:
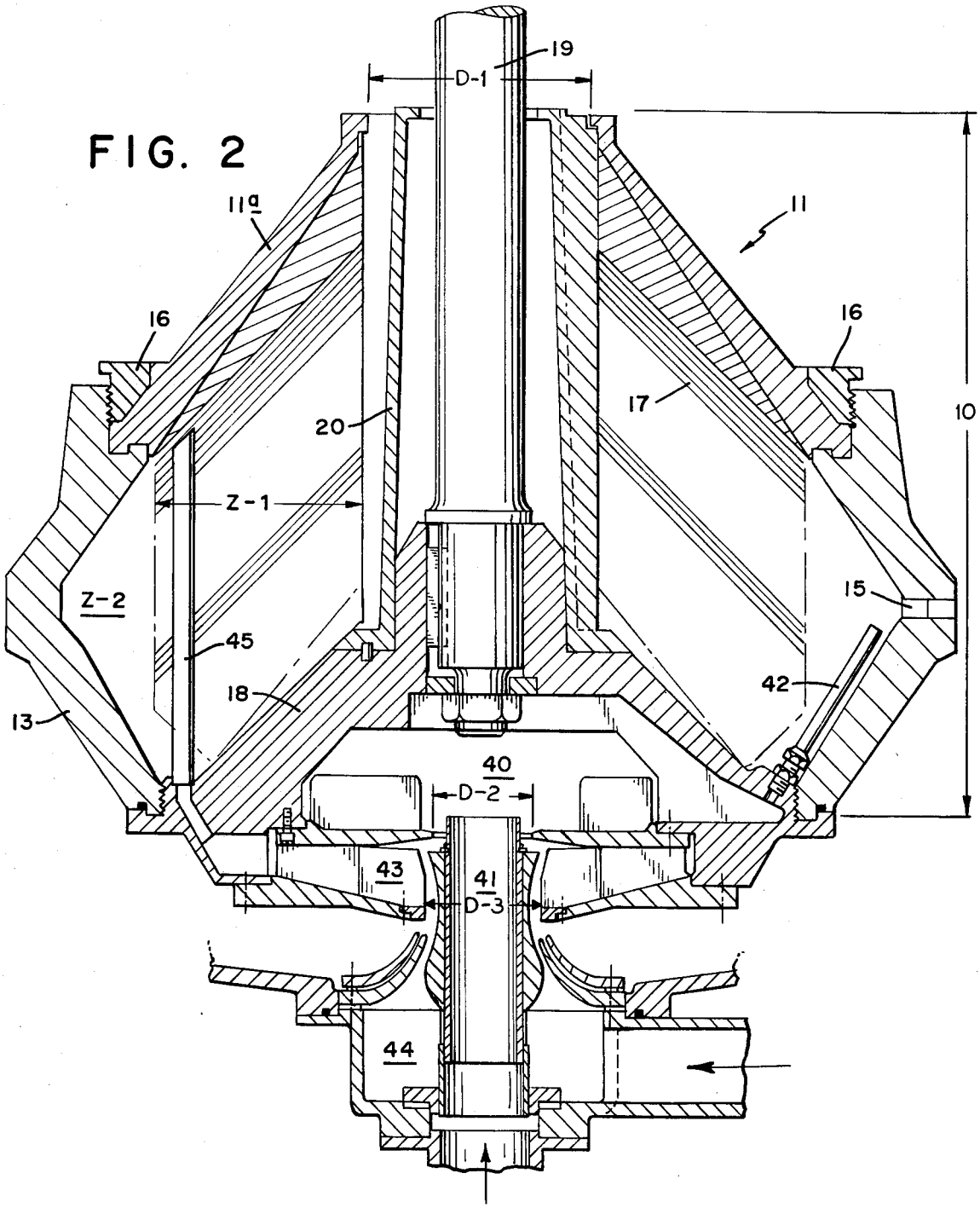
FIG. 2 is a vertical sectional view of the rotor similar to FIG. 1, embodying a reversal of parts.
Figure 9:
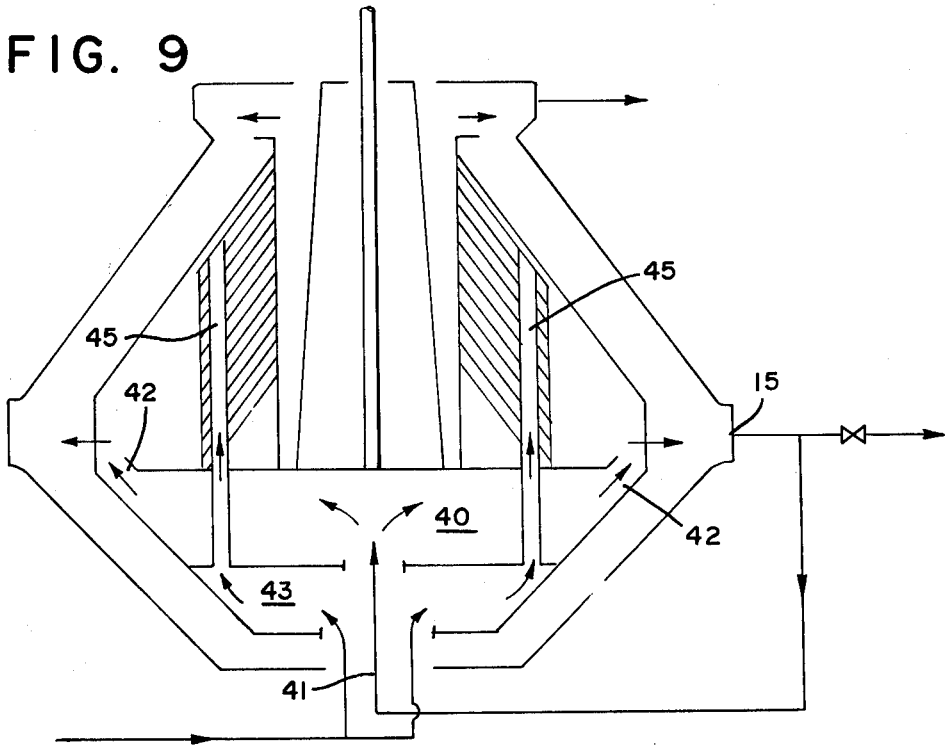

FIG. 9 is a schematic view of the rotor of the FIG. 2 embodiment, enclosed by a housing.

Figure 4:
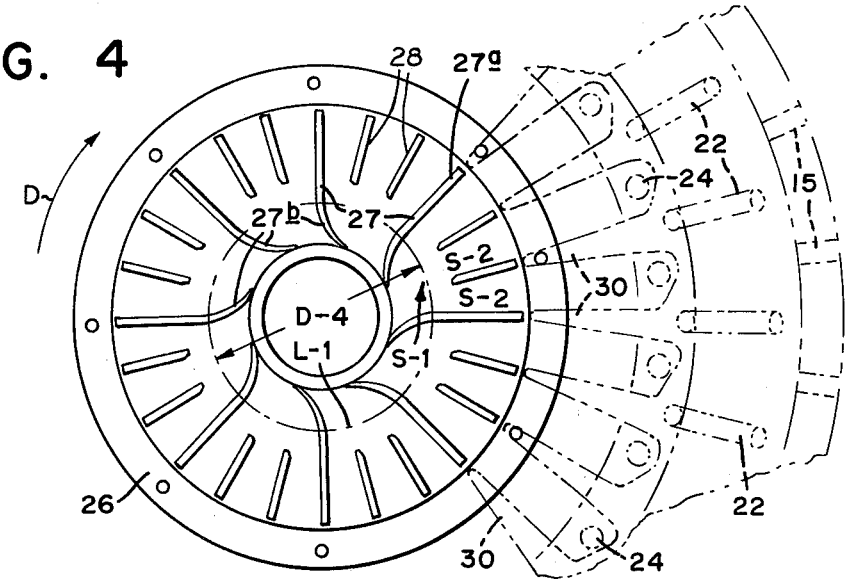
FIG. 4 is a detail plan view of an intermediate annular partition member of the pumping section, showing a combination of short pumping vanes with specially shaped long pumping vanes, to operate in the upper pumping chamber.

FIG. 10 is a plan view similar to FIG. 4, showing a modified form of the pumping vanes.

FIG. 11 is a plan view similar to FIG. 4, showing another modified form of the pumping vanes.

FIG. 12 is a vertical sectional detail view of a modified form of the intermediate annular partition plate separating the two pumping compartments, and connected to the upper as well as the lower pumping vanes.

FIGS. 13 and 14 are schematic illustrations of the remedial effect of the improved arrangement and configuration of the pumping blades, relative to prior practice.

FIG. 15 illustrates the condition of FIG. 13, in connection with a pair of standard straight accelerator vanes.

FIG. 16 illustrates the improved condition of FIG. 14, in connection with a pair of the improved accelerator vanes of this invention.

The centrifugal machine embodying one form of the invention in FIG. 1, is of the type constructed for a two phase separation of a feed slurry or solids suspension into the heavy fraction of a desired solids concentration, delivered by the rotor nozzles, and a light overflow fraction delivered at the top end of the rotor bowl. In this type of machine, feed slurry is introduced through the rotor bottom end, instead of downward through the top end of the rotor. Such bottom feed arrangement leaves the top overflow end unencumbered, thus avoiding what might be an undesirably large overflow diameter required for accommodating the top feed supply facilities.

Furthermore, since recirculation of a portion of the nozzle discharge product or underflow material back into the separating chamber of the rotor is normally required, provision is also made for the introduction thereof through the bottom end of the rotor into the outer centrifugal separating zone of the nozzles, that is the zone that surrounds the stack of separating discs.

The two slurries, that is the feed slurry and the return slurry to undergo separation, are pushed upwardly through the rotor by the pumping or impeller vanes of the respective annular pumping chambers. These pumping chambers presenting substantially identical pumping problems, occupy the smaller bottom end portion of the rotor, being located below the much greater centrifugal separating chamber or separating zones contained in the rotor bowl.

The invention is concerned with improving the pumping effectiveness of the two pumping chambers by an improved arrangement and novel combination of the respective sets of pumping vanes, thereby also improving the centrifugal separating efficiency of the machine, while also improving the power input requirements for effecting the separation.

The FIG. 1 embodiment of the improved machine, also represented schematically in FIG. 8, is now described as follows:

The rotor of this machine comprises a double cone shaped rotor bowl designated by the vertical dimension 10 comprising an upright frusto-conical top end section 11 having a top overflow opening 12 also designated by its diameter D-1, and an inverted trunco-conical section 13 having a wide bottom opening 13*a*. An intermediate peripheral section 14 of the bowl is provided with underflow discharge nozzles 15 for the heavy fraction. The top end section 11 in turn comprises an upper conical part 11*a* and a lower complementary section 11*b*, both part 11*a* and section 11*b* being detachably secured together by means of the conventional threaded locking ring 16. This bipartite construction of the rotor bowl provides access to a stack of separator discs 17 confined between the upper conical part 11*a* and a hub member 18 which closes the wide bottom opening 13*a* of the bowl. This hub member is of frusto-conical configuration, and formed with a downward facing hollow 18*a*. The stack of separating discs represents what is herein termed the first or inner annular separating zone *Z*-1. Surrounding this inner zone is what is herein termed the second or outer separating zone Z-2.

A rotor shaft 19 is fixed to the hub member in the well known manner shown, extending upwardly through the top overflow opening 12. This shaft is surrounded by a customary spider member 20 held in place by conical part 11*a* of the bowl, and secured against rotation relative to the hub member as by the provision of pegs 21.

Outwardly divergent pipes 22 for returning of underflow material from the nozzles, are equally spaced around the rotor axis, extending from the peripheral portion 23 of the hub member into the separating zone Z-2, but shown in staggered relationship to the nozzles. Through these divergent pipes return slurry is delivered into the outer separating zone Z-2, and into each of the spaces between respective nozzles. This means that there are as many return pipes 22 as there are nozzles, although in staggered relationship to one another, as it appears in the arrangement shown in FIG. 3.

Also extending upwardly from the peripheral portion 23 of the hub member is a set of vertical slurry feed pipes 24 equally spaced around the rotor axis, and penetrating the stack of separator discs. The vertical feed pipes 24 are in turn staggered with respect to the return pipes 22, whereby these vertical feed pipes 24 are placed radially in registry with the discharge nozzles. This relationship again is apparent in FIG. 3 showing that in the preferred construction the number of slurry feed pipes 24 is shown to be equal to the number of slurry return pipes 22, as well as equal to the number of the nozzles.

Figure 3:
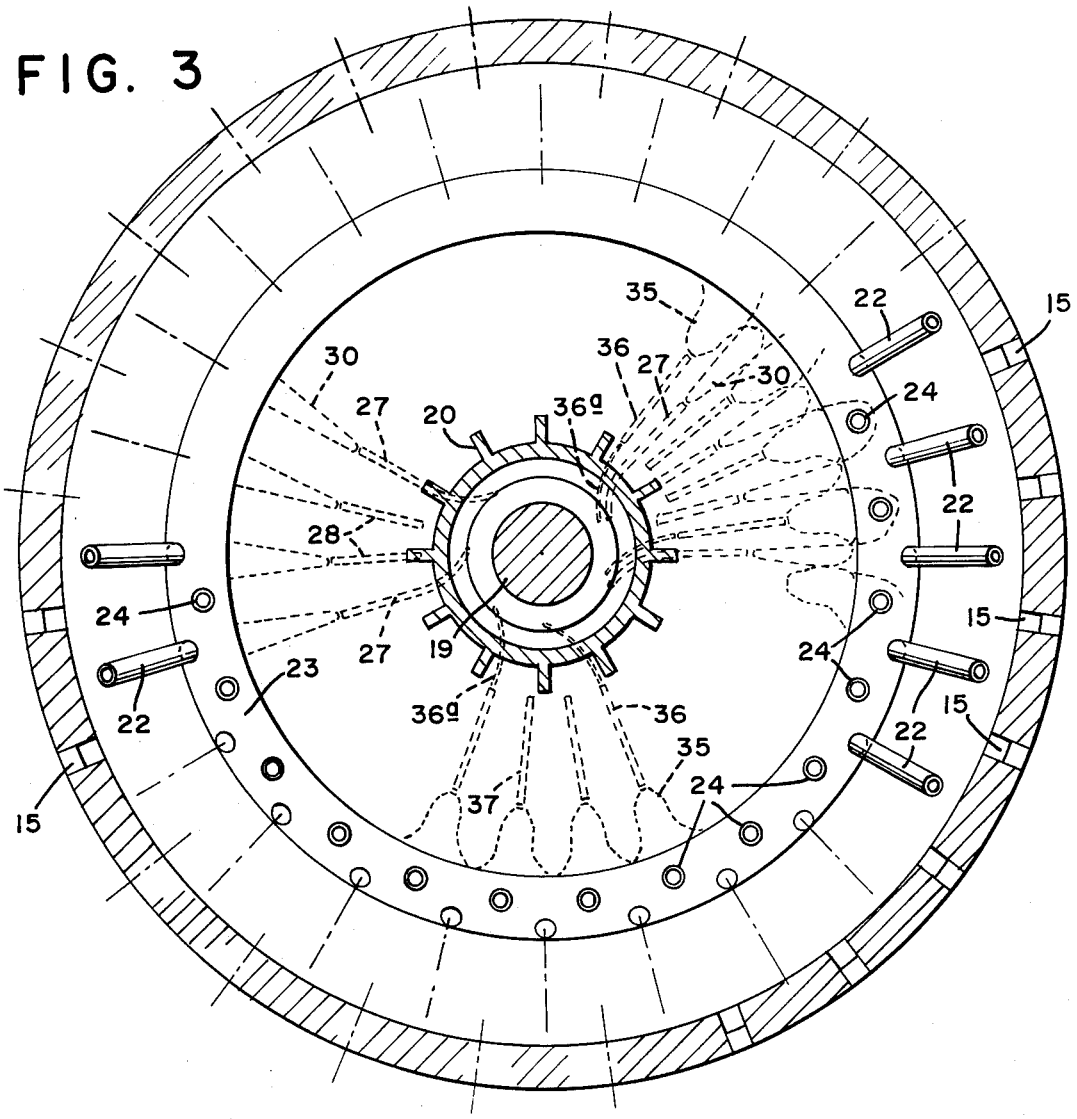
FIG. 3 is a cross-sectional view taken on line 3—3 in the FIG. 1 embodiment showing the relationship between the pumping vanes, the pipe system within the rotor bowl and the nozzles, in that embodiment. (Note: A similar cross-sectional view taken in FIG. 2 would be identical).

It is also seen from FIG. 3 that for a given number and spacing of the nozzles, the peripheral portions 23 of the hub member must accommodate both the return slurry pipes 22 and the feed slurry pipes 24, in other words double the number of the nozzles.

It can now be seen also, from FIG. 3, that the spacing of the respective sets of pipes 22 and 24 in turn controls the spacing of the pumping or impeller vanes in the respective pumping chambers where each of the pipes or tubes is served by an associated pair of pumping vanes, which relationship is also indicated in the arrangement shown in FIG. 3, as will be furthermore set forth below.

Under these conditions, a problem presents itself due to the relatively narrow spacing and possible malfunction of the radially straight pumping vanes heretofore in use in this type of machine. This problem was solved in the manner of this invention, by the improved construction of the two pumping chambers and the arrangement and configuration of the respective sets of pumping vanes, presently to be described.

The upper pumping chamber 25 is formed by the hollow 18*a* and by an intermediate annular partition plate 26 the central opening of which is designated by the diameter D-2. This pumping chamber communicates with the vertical feed slurry tubes 24. The annular plate 26 carries a set of upper upright pumping vanes (see FIG. 4) comprising a combination of long vanes 27 with foreshortened or stunted vanes 28 interposed between any two of the long vanes.

For the purposes of this invention the long vanes 27 in one form thereof have an outer radial body portion 27*a*, and a inner end portion 27*b* deviating in the direction D of rotation of the rotor. These deviating or curved outer end portions project from the liquid level L-1 inwardly to terminate in the vicinity of, or close to the central feed supply pipe 29 whereas the short vanes 28 remain submerged during operation of the machine. The circular dot-and-dash line L-1 of diameter D-4 indicates the average liquid level centrifugally maintainable in the upper pumping chamber, allowing for operational variations of the level inwardly or outwardly when the machine is in operation.

Feed slurry is supplied through a central feed pipe 29 extending through the intermediate annular plate 26.

With the fluid level L-1 established and maintained, (allowing for normal variation) it will be seen that the short vanes 28 are kept in submergence, while the curved or deviating inner end portions of the long vanes will remain unsubmerged, extending inwardly beyond the level L-1.

As indicated in FIGS. 3 and 4, each vertical feed slurry pipe 24 is served by a pair of the upper vanes. By way of example as shown in FIG. 4, there are two of the foreshortened radial vanes interposed between any two of the longer inwardly projecting vanes. It will be understood that the arrangement may be modified so that only one short vane or more than two could be interposed, depending upon the basic design factors of the machine.

The end curvature of the long vanes 27 has the effect of smoothly guiding the feed slurry radiating out from the supply pipe into the space S-1 between respective pairs of the long vanes 27. Combined with the end curvature the spacing of these vanes is such as to provide adequate entry passage area between them, with the result that back pressure and back spilling are avoided. Once the feed slurry has entered the space S-1 between the curved end portion 27*b* of the longer vanes, the submerged short vanes 28 take over the further distribution of the feed slurry into the spaces S-2 leading individually towards a respective vertical slurry feed pipe 24. In this connection it will be understood that the vanes as such have outward guiding as well as accelerating effect upon slurry being pumped, individually to the respective upstanding feed slurry tubes 24. It may also be noted at this juncture that technically, the function of pumping chambers in this machine is quite different from the operating principle of any common self-contained centrifugal pump.

Complementary radial fins or ribs 30 are provided to cooperate with each of the upper vanes. The fins extend inwardly from the inner face of hollow 18*a*, in radial alignment with each respective vane in the upper pumping chamber. These fins in effect constituting outward radial extensions of the vanes, provide conduits leading to, and communicating with respective upstanding slurry feed pipes 24.

A lower pumping chamber 31 is formed between the partition plate 26 and an annular bottom closure plate 32 which latter has a peripheral flange portion detachably bolted to the underside of a corresponding outer peripheral portion of hub member 18. The closure plate 32 has a central opening designated by its diameter D-3, and forming with the central slurry supply pipe 29 an annular passage 33 through which is injected upwardly the underflow return slurry supplied from an annular feed chamber 34 surrounding a lower exposed portion of the central slurry feed pipe 29, and connected the bottom of the machine housing indicated at 34*a*.

Figure 5:
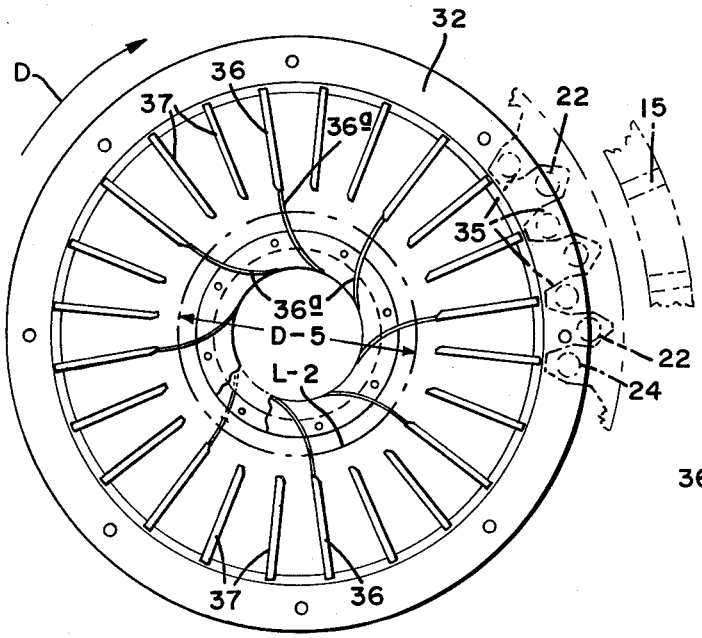
FIG. 5 is a detail plan view of an annular bottom closure member, showing a combination of short pumping vanes with specially shaped long pumping vanes, the long pumping vanes having curved inner end portions carried by a removable adaptor ring member.

The bottom closure plate 32 carries a combination of pumping vanes generally similar in effect to those in the upper pumping chamber described above. As seen in FIG. 5, these pumping vanes register radially with the discharge nozzles 15, while serving to distribute and supply return slurry to the divergent slurry return pipes 22. A usual return slurry conduit 15*a* is indicated in FIG. 8. Cooperating with these lower pumping vanes are complementary inwardly directed radial fins 35 (lightly indicated in FIGS. 3 and 5), and shown to be integral with the outer peripheral portion of the rotor hub. These fins are in alignment with the lower vanes, again constituting in effect outward radial extensions of these vanes, thus providing feed conduits leading to, and communicating with respective divergent slurry return pipes 22.

In this combination of FIG. 5 again, there are long vanes 36 having curved or deviating outer end portions 36*a* pointing in the direction D of rotation of the rotor. As in the upper pumping chamber, there are foreshortened radial vanes 37 interposed between the longer vanes. Again, under normal operating conditions, the short vanes may be in submergence as indicated by the centrifugally maintained fluid level L-2, whereas the curved end portions of the longer vanes project from the level L-2, inwardly, preferably extending to the edge of the central opening D-3 of the annular bottom closure plate 32. The circular level L-1 is designated also by its diameter D-5.

Figure 6:
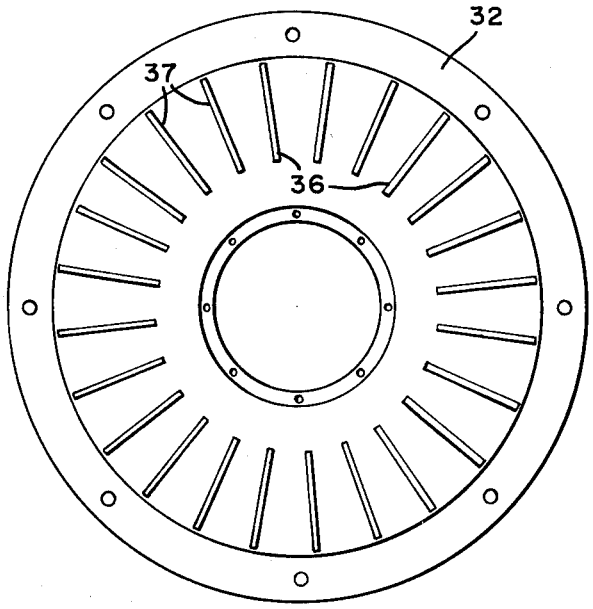
FIG. 6 is a plan view of the part of FIG. 5, with the adaptor ring member removed.
Figure 7A:
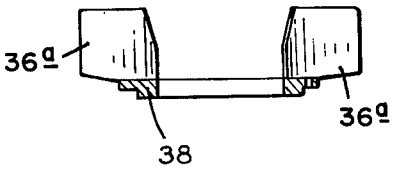

However, an added feature is shown to have been built into the combination of the lower vanes of FIG. 5, although equally applicable to the combination of the upper vanes. That feature lies in the provision of means whereby the curved or deviating end portions 36*a* of the longer vanes are rendered removable or exchangeable. For that purpose, these curved end portions, have their bottom edges fixed to an adaptor ring 38 removably connected to the inner edge portion of the annular bottom closure plate 32, as shown in FIGS. 1 and 5. In FIGS. 7 and 7*a* the adaptor ring per se with its curved vane portion 36*a*, is shown removed from its environment. FIG. 6 shows the part of FIG. 5 with only short radial stub vanes 39 remaining after removal of the adaptor ring, all of the remaining short or stub vanes 39 being shown to be identical.

With the improved pumping chambers constructed and arranged according to this invention, the aforementioned drawbacks and hidden problems are overcome, that otherwise would tend to affect the performance of this type of machine. Furthermore, with the improved pumping efficiency thus attainable due to the rearrangement and reorganization of the pumping vanes, the diameters D-4 and D-5 of respective centrifugal fluid levels L-1 and L-2 are relatively reducible, whereby in turn a corresponding reduction in power input requirement is attainable.

That is to say, as a result of this invention, the improved machine can be operated effectively with respect to attaining proper centrifugal fractionation, even though with the top overflow diameter D-1 reducible in the manner pointed out above. Reduction of diameter D-1 is attainable to the extent that the diameters D-4 and D-5 of fluid levels L-1 and L-2 are maintained safely within the top overflow diameter D-1, to insure unimpeded passage upwardly of the slurry factions through the machine. A relative reduction of the top overflow diameter however, means a corresponding reduction or saving in operating power.

It will be understood that various changes or alternatives are feasible with respect to the FIG. 1 embodiment shown, without departing from the spirit and scope of this invention.

For example, an alternative rotor construction shown in FIG. 2 (see also schematic FIG. 9) while generally similar to the one in FIG. 1 described above, shows a reversal of parts, such that the upper pumping chamber 40 will receive the return slurry from central feed pipe 41 for delivery through divergent slurry discharge tubes 42, while the lower pumping chambers 43 receiving the feed slurry from annular feed chamber 44, communicates with vertical feed slurry tubes 45. Each of the pumping chambers may be equipped with an arrangement or combination of pumping vanes, similar to that shown in the pumping chambers of the FIG. 1 embodiment of the rotor.

The configuration of the pumping vanes themselves may be modified, as long as they perform an identical or comparable function in accordance with the underlying concept of this invention. For example, as illustrated in FIG. 10, the long vanes in the combination, may simply have an angular break 46 providing the deviating end portion of the vane. Short vanes 46*a* are interposed between long vanes 46. In a another example (see FIG. 11) the entire long vane 47 is represented by a curve although outwardly registering with the fins 30 as shown in FIG. 4. The interposed foreshortened vanes 48 may be correspondingly curved, all curves thus leaning in the direction D of rotation of the rotor. The short vanes may be of differentiated length for reasons of flow distribution.

Depending upon individual requirements, only a single short vane, or else more than two, may be interposed between each pair of the longer vanes.

In some instances, the omission of the foreshortened interposed vanes may be permissible, reliance then being placed upon the guiding and accelerating effect of the associated complementary fins 30 and 35 extending inwardly from the hub member.

Looking at the pumping compartments of either the FIG. 1 or the FIG. 2 embodiment, another possible modification (see FIG. 12) becomes apparent, in that vanes 49 and 50 of the upper compartment are connected to the top side of an annular partition plate 51, and that vanes 52 and 53 are connected to the underside of the partition plate.

FIGS. 13 and 14 illustrate the remedial effect attainable by this invention in respect to the drawbacks of the earlier machine. FIG. 13 therefore illustrates the conditions encountered with the previously standard radially straight pumping vanes in view of the above stated dilemma of structural and functional requirements.

With the straight vanes, for the sake of this explanation it may be assumed that a fluid element E-1 of feed enters the impeller in the radial direction of arrow A at a speed that in negligibly small relative to the high velocity of the straight vane "S". As the particle gets into the path of the vane, it is hit directly by the speed V-T of the vane. It is visualized that upon impact the element E is split into two halves due to the momentum change upon the element. These halves then must move in opposite radial directions along the vane as indicated by the opposedly directed arrows − V-R and + V-R.

Thus, while one half moves in the desired direction namely radially outward, the other half is directed diametrically opposed. The thus misdirected portion − V-R will collide with other fluid elements, reducing the pumping ability of the vane, and impose turbulence, back pressure, and spillage upon the feed slurry supplied to the impeller. Under these heretofore unrecognized conditions in the machine, the rate of feed to such a machine had to be monitored and carefully controlled, and limited or reduced in order, by way of compromise, to attain an acceptable operating condition and fractionation. Merely shortening these radial vanes as above explained, would partially lighten the above adverse condition, but would not provide the basic remedy, while increasing the power input requirement due to increase of the top overflow diameter.

A break through was achieved, as illustrated in FIG. 14, with the pumping chambers and vanes constructed in the manner of this invention.

With the long curved impeller vanes accommodated in the improved construction, an element E-2 entering the impeller vane S-1 at point P-1 has a velocity V-2 relative to the vane, which velocity is tangent to the angular direction of rotation of the vane. As the element moves along the curve of the vane, the tangential velocity component V-T decreases to zero while the radial component V-R increases, as indicated by the vector diagrams at sequential points P-2, P-3, and P-4.

Hence, there is a smooth transition from tangential to radially outward velocity, with no energy losses due to turbulence, back pressure, and back spillage eliminated.

From the foregoing example illustration in the drawings it will be understood that the underlying concept of the invention is concerned with improving the function and pumping efficiency of the pumping chambers, and hence improving the overall performance of the machine, and that therefore various changes and modifications may fall within the scope of this invention.

More in particular, since a preferred construction of the rotor herein shown as a practical embodiment and example to illustrate the invention, it should be understood that the invention need not be limited to the precise number, spacing, or positions relative to one another of such elements as the nozzles, the vertical feed slurry tubes, the divergent return tubes, and the pumping vanes in the respective pumping chambers.

Therefore, in principle, for a given number of nozzles there would be provided an equal number of divergent return tubes, both the nozzles and the tubes equally spaced about the rotor axis, but independent of each other with respect to their relative positions.

The number of vertical slurry feed tubes, while equally spaced about the rotor axis, need not follow the pattern of arrangement shown in the present illustration of the invention. That is to say, the number as well as the position of these vertical tubes may be independent relative to the number and position of the divergent return tubes and the nozzles. These vertical tubes therefore may be arranged and accommodated according to design and preference requirements.

Consequently, the pumping vanes will be disposed in the respective pumping chambers in accordance with the number and position of the divergent return tubes and the vertical slurry feed tubes respectively, but independent of the position of the nozzles, and otherwise constructed and arranged in the manner and for the purpose of this invention, as above set forth.

FIG. 15 provides another illustration of the flow condition shown in FIG. 13. Accordingly, tentative flow lines F-1, F-2, F-3, and F-4 are shown to indicate accelerator flow conditions encountered in connection with a pair of the standard accelerator vanes A-1 and A-2 in a pumping chamber, with the possibility of back spilling indicated by arrows F-1 and F-2.

FIG. 16 provides another illustration of the improved flow conditions shown in FIG. 14. Accordingly, flow lines F-5 and F-6 are shown to indicate controlled and improved accelerator flow conditions in connection with a pair of accelerator vanes shaped and arranged in accordance with the invention, and based upon the discovery set forth above.

Liquid levels L-3 and L-4 are indicated in FIG. 15 and FIG. 16 respectively.

The vanes in the pumping section of the rotor are herein variously termed pumping vanes or accelerator vanes, their function being to impart guidance and acceleration to respective slurries towards a divergent return pipes and the vertical feed pipes respectively.

The vertical slurry feed pipes and the divergent return pipes, are herein also variously termed vertical feed tubes and divergent return tubes respectively.

We claim:

1. A nozzle type centrifugal machine adapted for a two phase separation of a feed slurry into a nozzle discharge slurry and an overflow of separated liquid, which comprises a rotor having a rotor bowl of double-conical configuration wherein the upper conical portion has a top opening at the narrow end providing an overflow for said separated liquid, wherein the inverted frusto-conical portion has a relatively wide bottom opening, and wherein a peripheral intermediate portion connects the wide ends of said conical portions, provided with discharge nozzles for said nozzle discharge slurry, a hub member of hollow frusto-conical configuration, closing the bottom end of the rotor bowl, a rotor shaft rising from said hub member through said overflow opening, a spider member concentrically surrounding said shaft, and extending from said hub portion upward substantially to the level of said overflow, and having radial ribs presenting outer vertical edges, a stack of separating discs fitted over said vertical edges of the spider member and representing an inner separating zone, said ribs thus forming vertical channels for the separated liquid from said zone to flow upwardly to said overflow, said stack of discs and said intermediate portion of the rotor bowl defining between them an outer separating zone wherein concentrated material collects for delivery through said nozzles, a set of vertical slurry feed pipes rising from the peripheral portions of said hub member, for delivering feed slurry to said stack of separating discs, said feed pipes being spaced evenly about the rotor axis, a number of outwardly divergent return pipes equal to the number of said nozzles, and extending from the peripheral portion of said hub member into said outer separating zone for delivery of nozzle discharge slurry into said outer separating zone, said return pipes being spaced evenly about the rotor axis, an upper annular partition member having a central feed opening coaxial with the rotor axis, and means for removably fastening said partition member to the underside of said hub member, surrounded by a peripheral portion of said hub member, said partition members thus constituting with the hollow of said hub member an upper pumping chamber, an annular bottom closure plate having a central feed opening coaxial with the rotor axis, means for removably fastening the peripheral portion of said closure plate to said peripheral portion of said hub member, said closure plate being spaced downwardly from said partition member so as to constitute therewith and with said peripheral portion of the hub member a lower pumping chamber, first conduit means for supplying one respective slurry to said upper pumping chamber, second conduit means for supplying the other respective slurry to said lower pumping chamber, one set of pumping vanes provided in one of said pumping chambers, said vanes being cooperatively associated with said vertical slurry feed pipes communicating with said one pumping chambers, and shaped so as to deviate in the direction of rotation of the rotor, and thus imparting to the incoming feed slurry outward acceleration, said vanes extending inwardly far enough to maintain delivery of separated liquid through the overflow, complementary accelerator fins extending from the inner face of said hollow hub member radially inwardly, and in alignment with the outer ends of the pumping vanes, and constituting outward extension of said pumping vanes, another set of pumping vanes provided in the other of said pumping chambers, said vanes being cooperatively associated with respective slurry return pipes communicating with said other pumping chamber, and shaped so as to deviate in the direction of rotation of the rotor, and thus imparting to the incoming return slurry outward acceleration, said vanes extending inwardly far enough to insure passage of said slurry through said divergent pipes, hydraulically balanced against the column of liquid reaching the top overflow, and complementary accelerator fins extending from said peripheral portion of the hub member radially inwardly, and in alignment with respective outer ends of the pumping vanes.

2. The centrifugal machine according to Claim 1, wherein said divergent slurry return pipes are located intermediate respective pairs of nozzles.

3. The centrifugal machine according to Claim 1, wherein said vertical slurry feed pipes communicate with said upper pumping chamber, and said divergent slurry return pipes communicate with said lower pumping chamber.

4. The centrifugal machine according to Claim 1, wherein said vertical slurry feed pipes communicate with said lower pumping chamber, and said divergent slurry return pipes communicate with said uper pumping chamber.

5. The centrifugal machine according to Claim 1, wherein said deviating vanes in at least one of said pumping chambers alternate with at least one short vane interposed between respective pairs of said deviating vanes.

6. The centrifugal machine according to Claim 1, wherein said deviating vanes in at least one of said pumping chambers have inner end portions carried by an adaptor ring member, and means for detachably connecting said ring member to the inner edge portion of the respective annular plate.

7. The centrifugal machine according to Claim 1, wherein said deviating vanes in at least one of said pumping chambers comprise a radially extending outer body portion aligned with a respective radial accelerator fin, and a deviating inner end portion.

8. The centrifugal machine according to Claim 1, wherein said deviating vanes in at least one of said pumping chambers comprise a radially extending outer body portion aligned with a respective radial accelerator fin, and a curved inner end portion.

9. The centrifugal machine according to Claim 1, wherein the pumping vanes in at least one of said pumping chambers comprise said deviating vanes alternating with at least one short vane interposed between a respective pair of deviating vanes, and wherein said deviating vanes comprise a radial body portion aligned with a respective accelerator fin, and a curved inner end portion.

10. The centrifugal machine according to Claim 1, wherein the vanes in at least one of said pumping chambers comprise said deviating vanes alternating with at least one short vane interposed between a respective pair of deviating vanes, wherein the upper vanes are connected to the top side of said annular partition plate, wherein the lower vanes are connected to the top side of said annular bottom closure plate, with the addition that the deviating vanes in at least one of said pumping chambers have inner end portions carried by an adaptor ring member, and means for detachably connecting said ring member to the inner edge portion of the respective annular plate.

11. The centrifugal machine according to Claim 1, wherein said deviating vanes in at least one of said pumping chambers are in the form of a curve having its outer end aligned with a respective accelerator fin, said curve leaning in the direction opposite to the direction opposite to the direction of rotation of the rotor.

12. The centrifugal machine according to Claim 1, wherein the vanes in at least one of said pumping chambers comprise said deviating vanes alternating with at least one short vane interposed between a respective pair of deviating vanes, wherein said deviating vanes are in the form of a curve having its outer end aligned with a respective accelerator fin, said curve leaning in the direction of rotation, and wherein said interposed short vane is substantially correspondingly curved.

13. The centrifugal machine according to Claim 1, wherein the deviating vanes in at least one of said pumping chambers have an inner deviating end portion terminating inwardly substantially tangential to the rotary speed vector of the vanes.

14. The centrifugla machine according to Claim 1, wherein the vanes in at least one of said pumping chambers comprise said deviating vanes alternating with two short vanes interposed between a respective pair of deviating vanes.

15. The centrifugal machine according to Claim 1, wherein the vanes in at least one of said pumping chambers comprise said deviating vanes alternating with two short vanes interposed between a respective pair of deviating vanes, said deviating vanes comprising a radially extending outer body portion aligned with a respective accelerator fin, and a curved inner end portion.

16. A nozzle type centrifugal machine adapted for a two phase separation of a feed slurry into a nozzle discharge slurry and an overflow of separated liquid, which comprises a rotor having a rotor bowl of double-conical configuration wherein the upper conical portion has top opening at the narrow end providing an overflow for said separated liquid, wherein the inverted frusto-conical portion has a relatively wide bottom opening, and wherein a peripheral intermediate portion connects the wide ends of said conical portions, provided with discharge nozzles equally spaced about the rotor axis for said nozzle discharge slurry, a hub member of substantially obtuse hollow frusto-conical configuration, closing the bottom end of the rotor bowl, a rotor shaft rising from said hub member through said overflow opening, a spider member concentrically surrounding said shaft, and extending from said hub portion upward substantially to the level of said overflow, and having radial ribs presenting outer vertical edges, a stack of separating discs fitted over said vertical edges of the spider member and representing an inner separating zone, said ribs thus forming vertical channels for the separated liquid from said zone to flow upwardly to said overflow, said stack of discs and said intermediate portion of the rotor bowl defining between them an outer separating zone wherein concentrated material collects for delivery through said nozzles, a set of vertical slurry feed pipes rising from the peripheral portions of said hub member, for delivering feed slurry to said stack of separating discs, the number of said vertical feed pipes being equal to the number of said nozzles, a set of outwardly divergent return pipes extending from the peripheral portion of said hub member into said outer separating zone for delivery of nozzle discharge slurry into said outer separating zone, the number of said return pipes being equal to the number of said nozzles as well as of said vertical slurry feed pipes, and arranged in alternation with said slurry feed pipes, an upper annular partition member having a central feed opening coaxial with the rotor axis, and means for removably fastening said partition member to the underside of said hub member, surrounded by a peripheral portion of said hub member, said partition member thus constituting with the hollow of said hub member an upper pumping chamber, an annular bottom closure plate having a central feed opening coaxial with the rotor axis, means for removably fastening the peripheral portion of said closure plate to said peripheral portion of said hub member, said closure plate being spaced downwardly from said partition member so as to constitute therewith and with said peripheral portion of the hub member a lower pumping chamber, first conduit means for supplying one respective slurry to said upper pumping chamber, second conduit means for supplying the other respective slurry to said lower pumping chamber, one set of pumping vanes provided in one of said pumping chambers, equal to the number of vertical feed pipes communicating with said one pumping chamber, said vane comprising long vanes alternating with at least one short vane interposed between two long vanes, and arranged so that any two mutually adjacent vanes will impel feed slurry to a respective associated vertical feed pipe, the long vanes being shaped so as to deviate in the direction of rotation of the bowl, and thus imparting to the incoming feed slurry outward radial acceleration, said long vanes extending inwardly far enough to maintain delivery of separated liquid through the top overflow, complementary accelerator fins extending from the inner face of said hollow hub member radially inwardly, and in alignment with the outer ends of said pumping vanes, and constituting radial outward extensions of said pumping vanes, another set of pumping vanes provided in the other pumping chamber, equal to the number of said divergent slurry return pipes communicating with the other of said pumping chambers, said vanes comprising long vanes alternating with at least one short vane interposed between two long vanes, and arranged so that any two mutually adjacent vanes will impel return slurry to a respective associated divergent pipe, the long vanes being shaped so as to deviate in the direction of rotation of the bowl, and thus imparting to the incoming feed slurry outward radial acceleration, said long vanes extending inwardly far enough to insure passage of said slurry through said divergent pipes, hydraulically balanced against the column of liquid reaching the top overflow, and complementary accelerator fins extending from the peripheral portion of said hub member radially inwardly and in alignment with the outer ends of said pumping vanes.

17. The centrifugal machine according to Claim 16, wherein said slurry return pipes are located intermediate respective pairs of nozzles, so that the vertical slurry feed pipes are arranged in the general direction of radii substantially in registry with the nozzles.

18. The centrifugal machine according to Claim 16, wherein said vertical slurry feed pipes communicate with said upper pe4"ing chamber, and said divergent slurry return pipes communicate with said lower pumping chamber.

19. The centrifugal machine according to Claim 16, wherein said divergent slurry return pipes communicate with said upper pumping chamber, and said vertical slurry feed pipes communicate with said lower pumping chamber.

20. The centrifugal machine according to Claim 16, wherein said divergent slurry return pipes are located intermediate respective pairs of nozzles, so that the vertical slurry feed pipes are arranged in the general direction of radii substantially in registry with the nozzles.

21. The centrifugal machine according to Claim 16, wherein said long vanes alternate with at least two short vanes interposed between two long vanes.

* * * * *